US010023446B2

(12) United States Patent
Cudney et al.

(10) Patent No.: US 10,023,446 B2
(45) Date of Patent: Jul. 17, 2018

(54) TRANSFORMABLE TABLE

(71) Applicant: Shinn Fu Corporation, Taipei (TW)

(72) Inventors: Derek Ryan Cudney, Prairie Village, KS (US); Ryan A. Jorgensen, Blue Springs, MO (US)

(73) Assignee: Shinn Fu Corporation, Taipei (TW)

( * ) Notice: Subject to any disclaimer, the term of this patent is extended or adjusted under 35 U.S.C. 154(b) by 393 days.

(21) Appl. No.: 14/976,879

(22) Filed: Dec. 21, 2015

(65) Prior Publication Data

US 2017/0174487 A1 Jun. 22, 2017

(51) Int. Cl.

| | |
|---|---|
| ***B66F 7/16*** | (2006.01) |
| ***B66F 7/28*** | (2006.01) |
| ***B66F 7/06*** | (2006.01) |
| ***B66F 7/08*** | (2006.01) |

(52) U.S. Cl.

CPC ..... *B66F 7/28* (2013.01); *B66F 7/065* (2013.01); *B66F 7/0625* (2013.01); *B66F 7/08* (2013.01)

(58) Field of Classification Search

USPC ..... 254/86, 93 L, 133 R, 134; 108/86, 87

See application file for complete search history.

(56) References Cited

U.S. PATENT DOCUMENTS

| | | | | |
|---|---|---|---|---|
| 2,956,645 | A | 10/1960 | Halstead | |
| 2,962,980 | A | 12/1960 | Carrigan | |
| 3,690,407 | A * | 9/1972 | Cullison | E04G 1/152 182/119 |
| 3,713,515 | A | 1/1973 | Hott | |
| 4,084,790 | A | 4/1978 | Molnar | |
| 5,031,726 | A | 7/1991 | Wakamiya | |
| 5,340,082 | A * | 8/1994 | Holloway | B66F 7/0625 187/211 |
| 8,550,011 | B2 * | 10/2013 | Lee | A47B 1/03 108/86 |
| 8,869,943 | B2 | 10/2014 | Matthews et al. | |
| 9,138,889 | B2 * | 9/2015 | Liu | B66F 7/28 |

* cited by examiner

*Primary Examiner* — Joseph J Hail

*Assistant Examiner* — Shantese McDonald

(74) *Attorney, Agent, or Firm* — Lathrop Gage L.L.P.

(57) ABSTRACT

Embodiments of transformable tables are disclosed. A transformable table has a lifting mechanism and a platform secured to the lifting mechanism. The platform has a stationary panel; a plurality of expansion panels positioned on either side of the stationary panel; and a plurality of extension panels in slidable engagement with the expansion panels and the stationary panel. The stationary panel, the expansion panels, and the extension panels are formed from a plurality of hollow tubes, and the hollow tubes re spaced apart a predetermined distance to form forming spaces therebetween and are secured together with a reinforcement member. The expansion panels extend laterally outward from the stationary panel, and the extension panels extend longitudinally outward from the connection with the expansion panels and the stationary panel.

20 Claims, 8 Drawing Sheets

100
110
105
180
130
255
252
190
195
230

TRANSFORMABLE TABLE

BACKGROUND

Vehicles take a number of different shapes and sizes, and therefore often require specialized lifts. Moreover, different lifts may be required for different projects. For example, there may be instances where it is advantageous for the vehicle lift to be positioned under the frame of the vehicle. In other instances, it may be advantageous for the vehicle to be lifted under its wheels. It is burdensome to purchase and store a separate lift for each vehicle and every occasion. Accordingly, it would be beneficial to have a lift that can be modified to fit a variety of vehicles.

SUMMARY

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

In one embodiment, a transformable table has a lifting mechanism and a platform secured to the lifting mechanism. The platform has a stationary panel; a plurality of expansion panels positioned on either side of the stationary panel; and a plurality of extension panels in slidable engagement with the expansion panels and the stationary panel. The stationary panel, the expansion panels, and the extension panels are formed from a plurality of hollow tubes, and the hollow tubes re spaced apart a predetermined distance to form forming spaces therebetween and are secured together with a reinforcement member. The expansion panels extend laterally outward from the stationary panel, and the extension panels extend longitudinally outward from the connection with the expansion panels and the stationary panel.

In another embodiment, a transformable table has a frame, comprising a base and a hydraulic pump secured to the base. A platform is secured to the frame via a plurality of connection members. The platform has first and second platform supports that extend substantially along the length of the base. The platform further includes a plurality of expansion supports that extend perpendicularly between, and are supported on, the platform supports. Each expansion support has two expansion support members spaced apart so as to form a channel therebetween. A stationary panel comprising a plurality of hollow tubes secured together at predetermined intervals is secured atop the expansion supports as part of the platform. And a plurality of expansion panels us adjustably secured to the expansion supports, each expansion panel including a plurality of hollow tubes secured together at predetermined intervals; and a brace secured to an underside of the expansion panel. The brace has a channel formed therein. The platform still further includes a plurality of extension panels. Each extension panel has a plurality of hollow tubes secured together at predetermined intervals via a reinforcement member. The hollow tubes of the extension panel are positioned in the spaces of the expansion panels. Rollers are positioned between the space in the expansion supports, and the brace engages with the rollers such that the expansion panels are movable in a laterally outward direction from a contracted position to an expanded position. The extension panels are movable in a longitudinally outward direction from a contracted position to an expanded position.

In still another embodiment, a transformable table has a platform having a stationary panel; a plurality of expansion panels positioned on either side of the stationary panel; a plurality of extension panels in slidable engagement with the stationary panel and the expansion panels; and step plates secured under each of the respective expansion. The stationary panel, the expansion panels, and the extension panels are formed from a plurality of hollow tubes, and the hollow tubes are spaced apart a predetermined distance to form spaces therein and are secured together with a reinforcement member. The extension panels are positioned in the spaces formed between the hollow tubes of the stationary panel and the expansion panels such that the expansion panels translate laterally outward from a position adjacent the stationary panel and the extension panels translate longitudinally outward from engagement with the stationary panel and the expansion panels. The table further includes a platform support system that includes a plurality of platform supports extending lengthwise along, and secured to, the outer edges of the expansion panels; and a plurality of expansion supports extending between the platform supports; and a plurality of connection members extending lengthwise between, and secured to, the expansion supports. The expansion panels engage with rollers secured to the expansion supports to translate from the contracted position to the expanded position.

DETAILED DESCRIPTION

Figure 1:
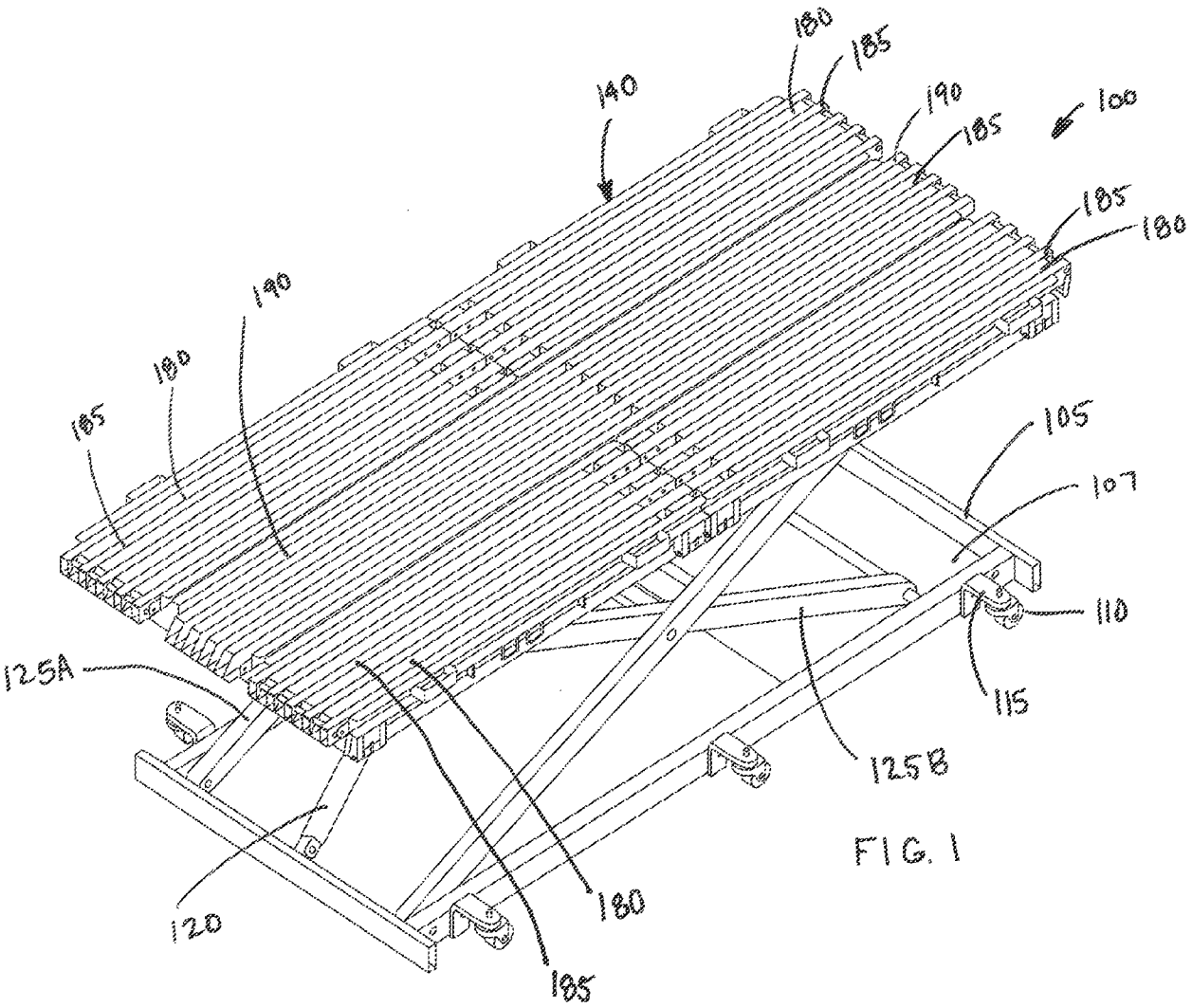
FIG. 1 is a perspective view of a transformable table according to one embodiment of the invention.

Embodiments of vehicle lifts are described herein. In one embodiment of the invention, a transformable table 100 includes a base frame 105 having an opposing set of legs 125 connected to a platform 140 that includes a plurality of expansion panels 180, extension panels 185, and stationary panels 190.

The base frame 105 may be, for example, a four sided structure, such as that shown in FIG. 1. The base frame 105 may additionally include a base plate 107 for extra support. Opposing sets of legs 125*a* and 125*b* (e.g., scissor legs) may be secured inside the frame 105. To maintain the legs 125*a* and 125*b* in concert, the legs 125*a* and 125*b* may be secured together at one or more ends by a crossbar 130. The crossbar 130 may extend beyond an outside facing surface of the legs 125*a* and 125*b* and engage with a channel in opposing sides of the frame 105. The legs 125*a* and 125*b* may be further reinforced together with a strut 127 extending between the two sets of legs 125*a* and 125*b*. The base frame 105 may be further equipped with wheels 110 secured to the frame 105 via brackets 115. The wheels may be equipped with brakes to ensure that the frame 105 does not shift while a vehicle is in a lifted position.

A hydraulic cylinder 120, or other lifting mechanism, may be attached to one side of the base 105 for lifting the platform 105. It shall be appreciated that the lifting mechanism is configured to lift the platform 105 such that the platform 105 is maintained in a substantially flat position to prevent a vehicle resting thereon from shifting while the platform is raised from a lowered to a raised position.

As noted above, the platform 140 includes a plurality of expansion panels 180, a plurality of extension panels 185, and a stationary panel 190. As shown in FIG. 1, the stationary panel 190 extends lengthwise along the middle of the platform 140. Four expansion panels 180 flank the stationary panel 190, one on either side of the top and bottom of the stationary panel 190. As described in greater detail below, the extension panels are situated between the voids formed in the expansion panels 180 and the stationary panel 190.

The panels 180, 185, and 190 may be formed of hollow tubes, for example, square tubes, to provide a flat surface for supporting a vehicle. However, other shapes of tubes may be acceptable, including cylindrical tubes. The tubes of the various panels 180, 185, and 190 may be uniformly sized such that the surface of the platform 140 is congruous.

Figure 2:
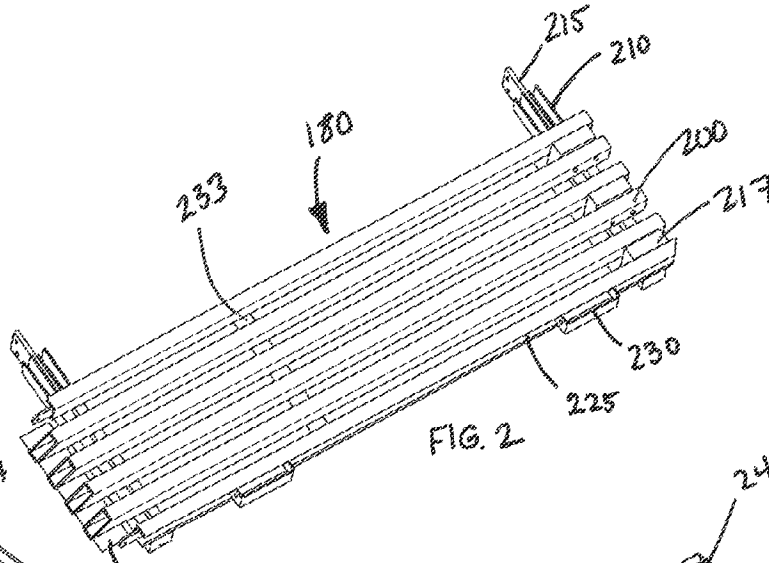
FIG. 2 is a bottom perspective view of a platform of the transformable table according to FIG. 1.
Figure 4:
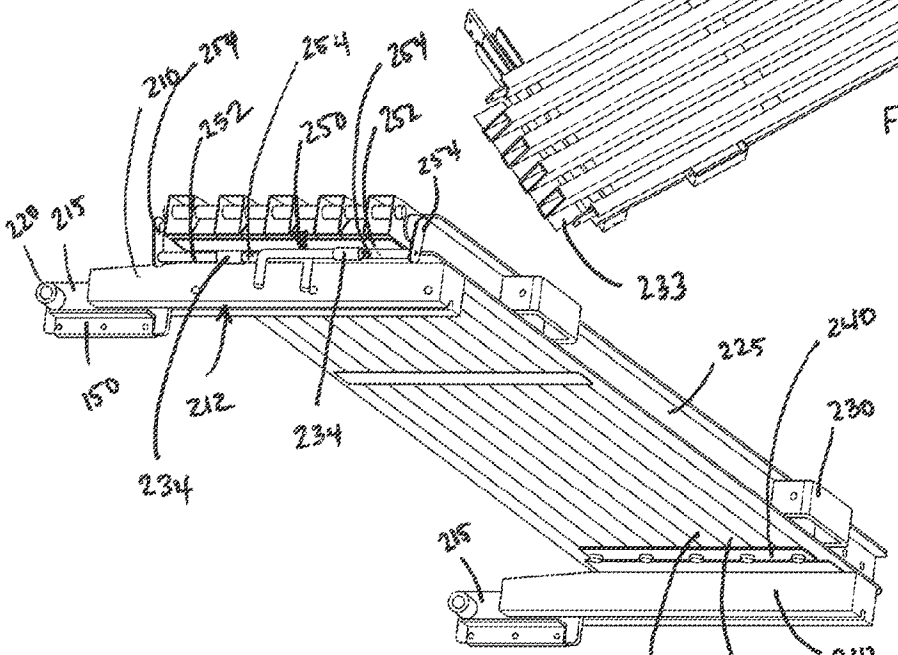
FIG. 4 is a top perspective view of the expansion panel of FIG. 3.

FIGS. 2 and 4 illustrate an expansion panel 180 according to an embodiment of the invention. The expansion panel 180 includes a plurality of hollow tubes 200 secured together at the underside via reinforcement members 233. The reinforcement members 233 may be welded to the underside of the tubes 200 of the expansion panel 185, or alternately, may be secured via mechanical fasteners. The tubes 200 of the expansion panel 180 may be angled at one end to minimize the overall length of the expansion panel 180 when the extension panel 185 is in a contracted position. The expansion panel 180 may further include an end plate 225 along the outer lateral edge. The end plate 225 may include at least one handle 230 which may be used for moving the expansion panel 180 from the contracted position to the expanded position.

Figure 3:
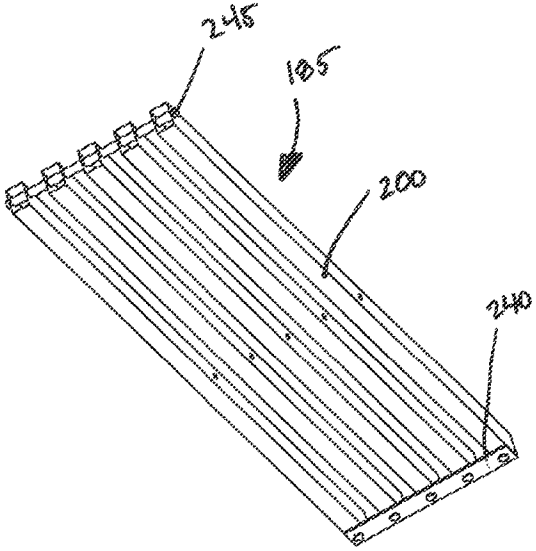
FIG. 3 is a bottom perspective view of a combination extension and expansion panel of the platform of FIG. 2.

FIG. 3 illustrates an extension panel 185. The extension panel 185 may also be constructed of hollow tubes 200 and secured together via a reinforcement member 240 which may be welded or otherwise secured to the tubes 200 at one end of the tubes 200. At the end of the extension panel 185 opposite the reinforcement member 240, a pin 245 may be inserted through apertures formed in the tubes 200 of the extension panel 185 to aid in keeping the extension panel tubes 200 connected. The pin 245 may be positioned such that it clears the angled edges of the expansion panel 180.

The hollow tubes 200 of the panels 180, 185, 190 may be secured together at predetermined intervals such that there is space between each of the tubes 200. The space between the tubes 200 of the expansion panel 180 may be defined by the size of the tubes 200 of the extension panel 185, and vice versa. For example, if the tubes 200 of the expansion panel 180 and the extension panel 185 are uniformly sized (e.g., 1 inch square), the tubes 200 of the expansion panel 180 are spaced to allow for the tubes 200 of the extension panel 185 to fit therebetween. Spacers 217 may be inserted between various tubes 200 which may aid in ensuring correct spacing between the tubes 200. FIG. 4 illustrates how an expansion panel 180 and an extension panel 185 fit together.

Figure 5:
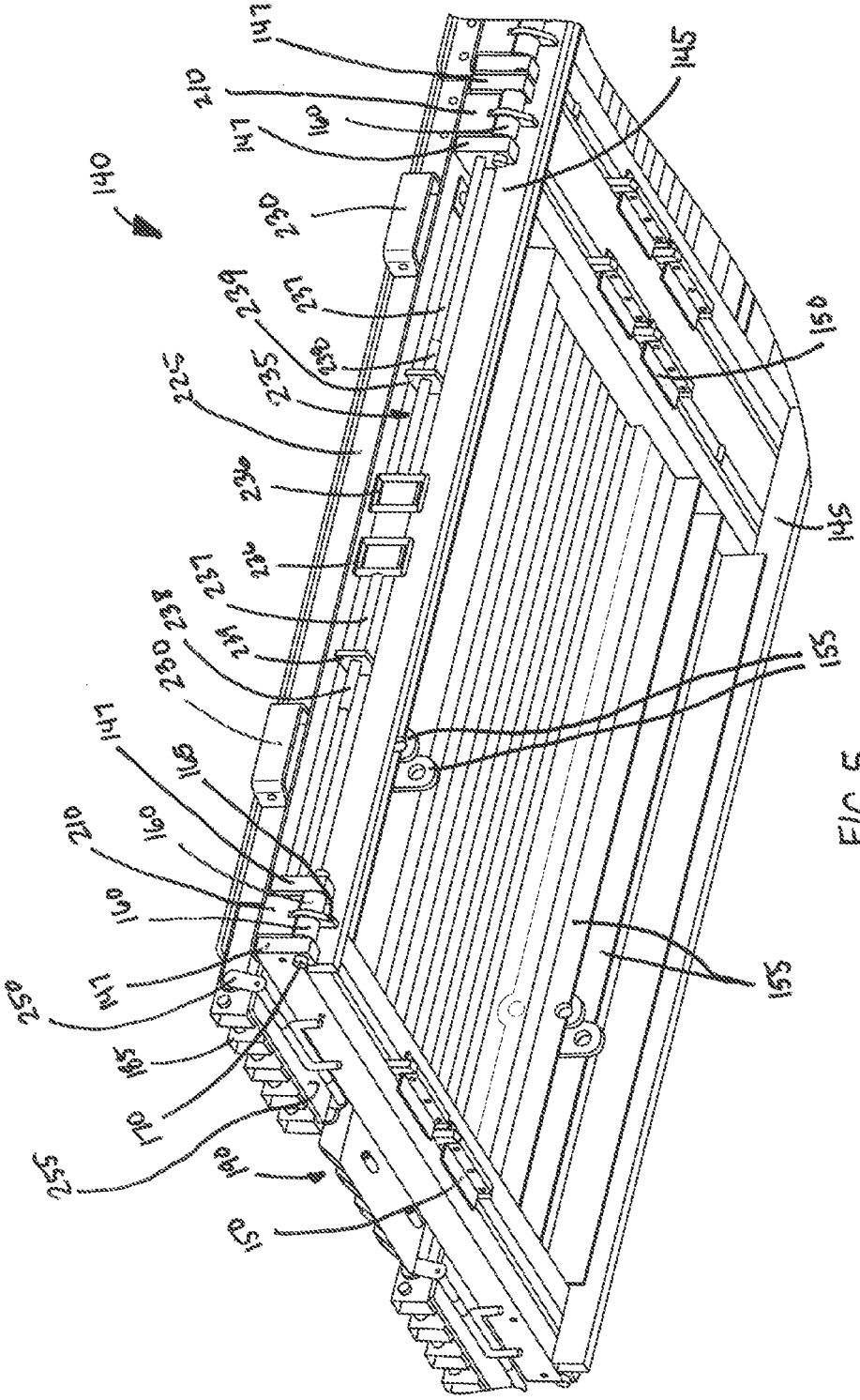
FIG. 5 is a bottom perspective view of the extension panel of FIG. 3.

A brace 210 may be provided on either longitudinal end of the expansion panel 180, and may be secured to the panel 185 via any fastening means. The brace 210 may include a conduit 212 which engages with a rib 165 as described below. A brace plate 215 may be provided along the inside lateral edge of the brace 210. An expansion bracket 150 is secured around the underside edge of the brace plate 215. As described in greater detail below, the brackets 150 secure the expansion panels 180 to expansion panel supports 147 through an open channel between the expansion panel supports 147 (FIG. 5). Rollers 220 may also be provided on the brace plate 215. The rollers 220 may further engage with the expansion panel supports 147 to aid in moving the expansion panels 180 from a contracted position to an expanded position, and vice versa.

Figures 6A, 6B:
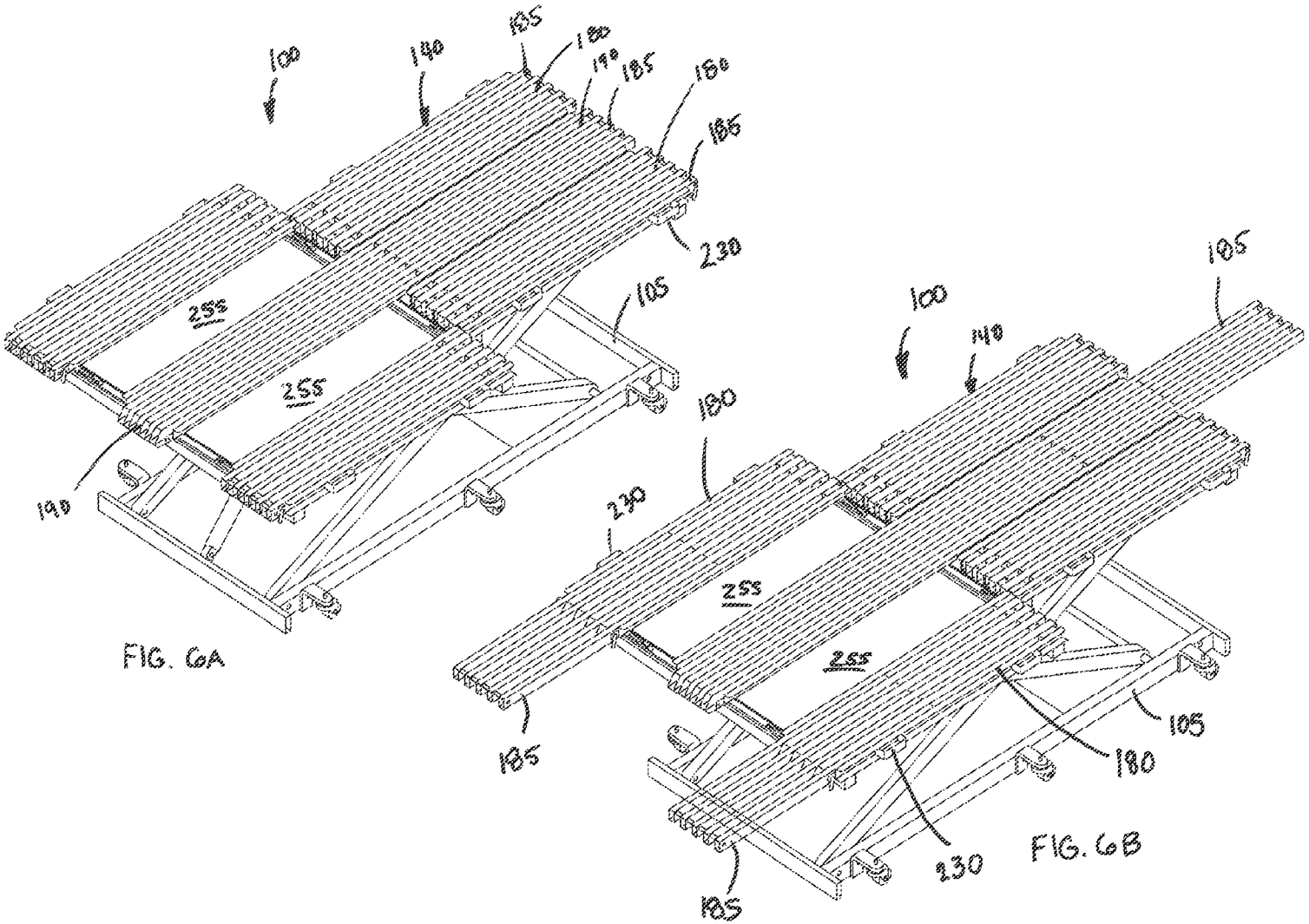
FIG. 6A is a top perspective view of the transformable table of FIG. 1 showing two expansion panels in an expanded position.
FIG. 6B is a top perspective view of the transformable table of FIG. 6A, additionally showing three extension panels in a semi-extended position.

As shown in FIG. 4, an extension panel spring loaded release latch 250 may be attached to the underside of a reinforcement member 233. The spring loaded release latch 250 includes two "L" shaped pins 252, a spring 253, and an engagement member 254 secured to the end of either pin 252. The springs 253 may be placed on the respective pins 252 and inserted through receptacles 234 formed on the reinforcement member 233. The engagement members 254 on the respective pins 252 may engage with apertures located in the expansion panel end plate 225 and the outside tubes 200 of the extension panel 185 to lock the extension panel 185 in the contracted position. To move the extension panel 185 into an extended position, the handle portions of the pins 252 may be squeezed together, thus causing the springs 253 to contract against the receptacles 234, and the engagement members 254 to move out of the respective apertures in the panels 180 and 185. The extension panel 185 may then be moved longitudinally outward, as shown in FIG. 6B, to extend the length of the table 100. When the extension panel 185 is in the desired extended position, the pins 252 may be released, and the engagement members 254 may again engage with the apertures in the expansion panel 180 and apertures at a position along the length of the extension panel 185.

Now referring to FIG. 5, the platform 140 may be supported from the underside by platform supports 145 extending lengthwise along an underside of the platform 140. Expansion panel supports 147 may extend between the platform supports 145 and may be supported thereon at the ends of the panel supports 147. Two expansion panel supports 147 may be provided at each end of the expansion panels 180 and may be spaced apart so as to form a channel therebetween. The brace 210 fits inside the channel and the brackets 150 keep the brace 210 in the channel. Accordingly, the brackets 150 may be secured to the brace 210 after the brace 210 is in engagement with the channel formed between the expansion panel supports 147.

A rib 165 may be secured to the platform support 145 to engage with the conduit 212 in the brace 210. Rollers 160 may be placed on either side of the rib 165, and a pin 170 may be inserted through the rollers 160,the apertures in the expansion panel supports 147, and the rib 165.

Expansion panel spring loaded latches 235 may be provided along the expansion panel end plates 225. The expansion panel spring loaded latch 235 may include a spindle 237 extending from a handle 236, and a spring 238. The spindle 237 may be inserted through an aperture in a spring panel 239 attached to an outside edge of the connection member 155 or a top edge of the platform supports 145. The spring 238 may be received onto the spindle 237 such that the spring 283 abuts the spring panel 239 opposite the handle. The end of the spindle 237 may be inserted through an aperture in an inside edge of the inside expansion support member 147 and a respective corresponding aperture in the brace 210 to lock the expansion panel 180 in the contracted position.

To move the expansion panel 180 into the expanded position, the handles 236 are pulled away from the respective expansion supports 147, causing the springs 238 to contract against the spring panels 239, and the end of the spindles 237 to leave the apertures in the respective expansion supports 147 and braces 210. With the expansion panel spring loaded latches 235 disengaged from the brace 210 and the expansion support 147, the respective expansion panel 180 can be moved laterally outward from the stationary panel 190 to extend the width of the table 100.

When the expansion panel 180 is in the desired position, the latches 235 may be released, and may engage with apertures located along the length of the expansion panel 180 to lock the expansion panel 180 in position. FIG. 6A illustrates expansion panels 180 in an expanded position.

Step plates 255 may be provided under the expansion panels 180. When the expansion panel 180 is in the expanded position, the step plate 255 may provide a secondary surface which may be useful to prevent parts and/or tools from falling to the floor, and may also reduce the risk of an accident occurring when a vehicle is loaded onto the table 100. The step plates 255 may be supported by connection members 155 and/or the platform supports 145.

The platform 140 may be secured to the base frame 105 via the connection members 155. To allow the platform 140 to be removed from the base frame 105, the connection members 155 may be mechanically secured to the base frame 105, for example, via nuts and bolts, clevis pins, or other appropriate mechanical fasteners.

Figure 7A:
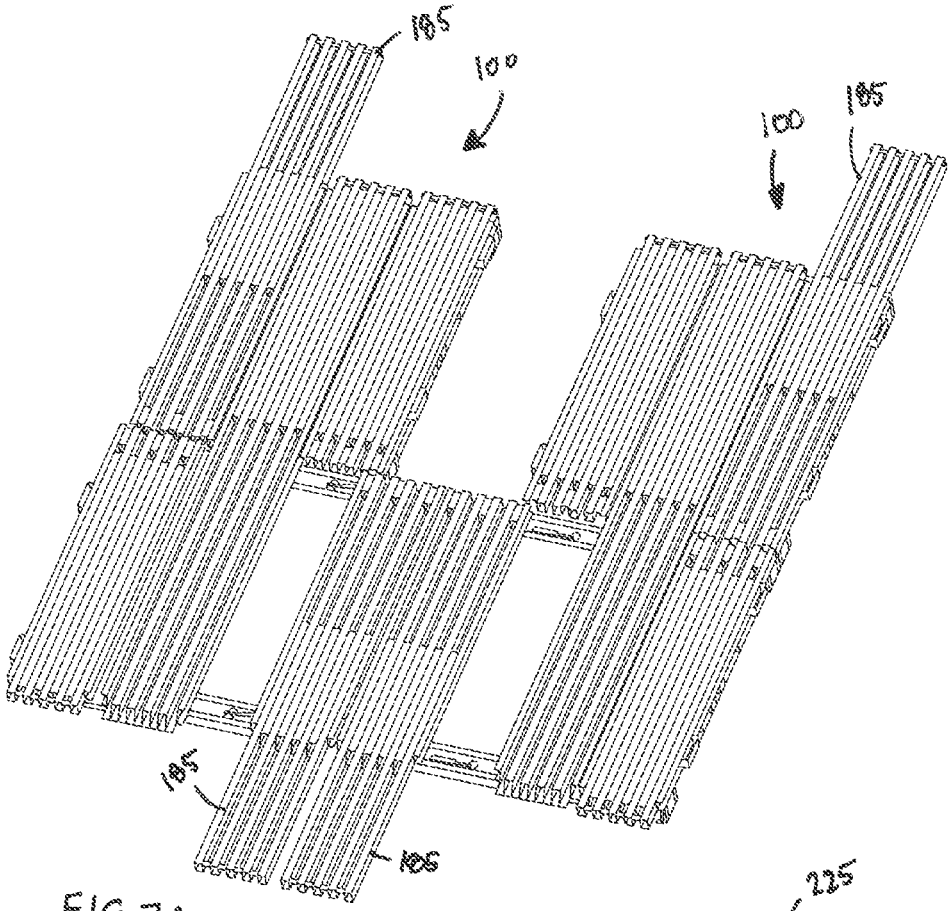
FIG. 7A is a top perspective view of connected platforms of two respective transformable tables according to another embodiment of the invention.
Figure 7B:
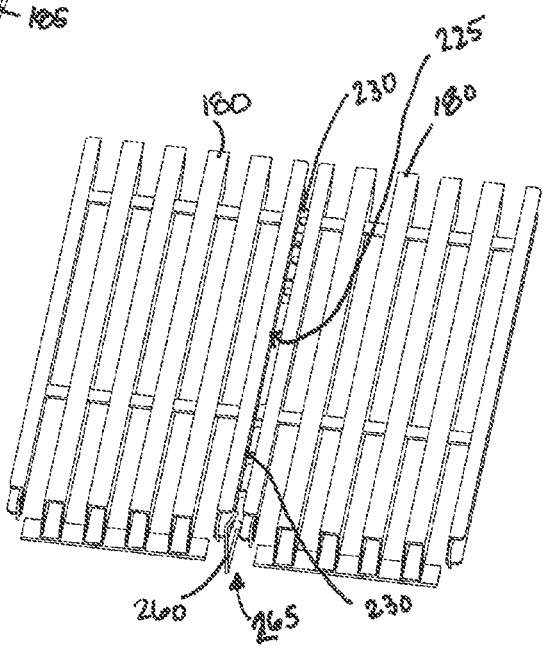
FIG. 7B is a top perspective view of a connection point between two expansion panels of the platform of FIG. 7A.

Referring now to FIGS. 7A and 7B, multiple tables 100 may be secured together to further increase the width of the table 100. A connection point 265 may be formed at the intersection of handles 230 on respective right and left end plates 225 of two transformable tables 100. Accordingly, the handles 230 may be offset on the end plates 225 of the right and left expansion panels 180 so as to accommodate the connection of two tables 100. A pin 260 may be inserted through holes formed into the handles 230 to lock the tables together. The physical connection between the tables 100 helps to ensure that the hydraulic cylinders 120 of the two tables 100 are synced such that the combined platform 140 is maintained in a substantially flat position when raised.

Figure 8C:
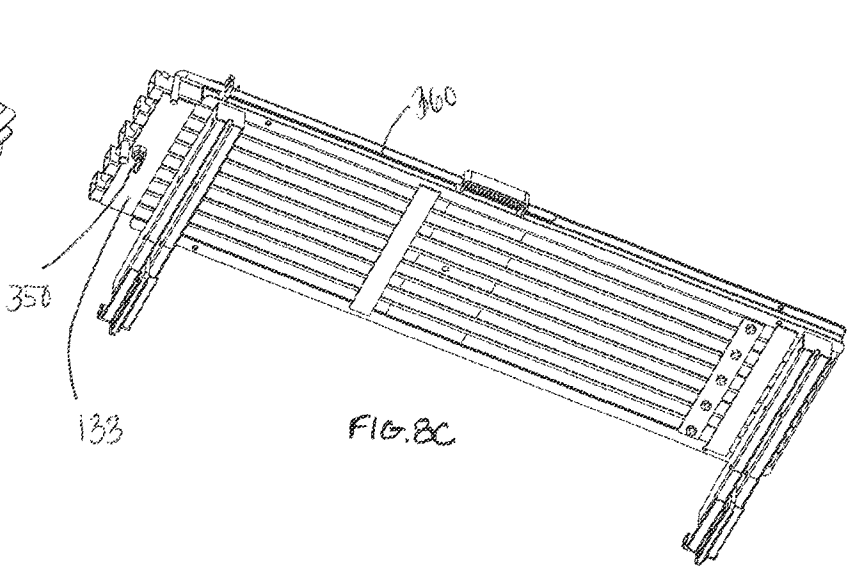
FIG. 8C is a bottom view of the combination extension panel and expression panel of FIG. 8B.
Figure 8B:
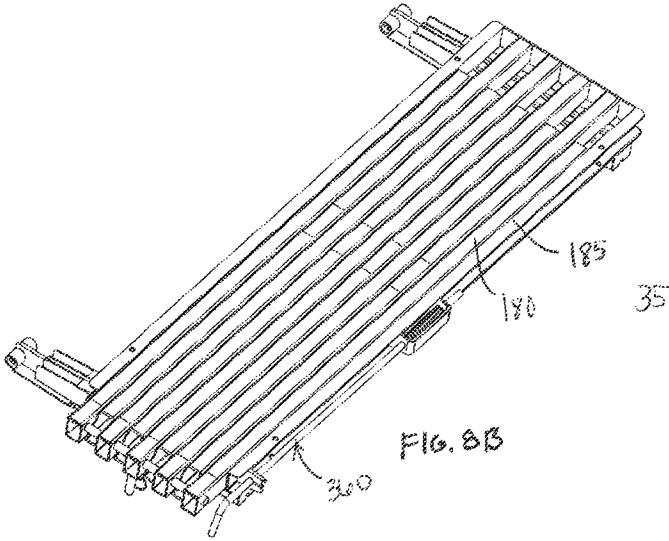
FIG. 8B is a top view of the combination extension panel and expansion panel of FIG. 8A in a contracted position.
Figure 8A:
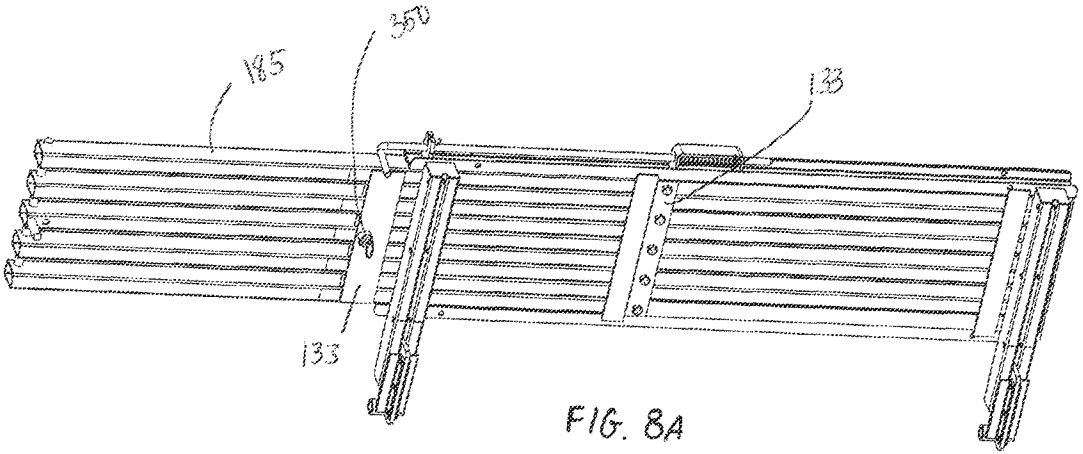
FIG. 8A is a bottom perspective view of an expanded combination extension panel and expansion panel showing a spring loaded plunger.
Figure 9:
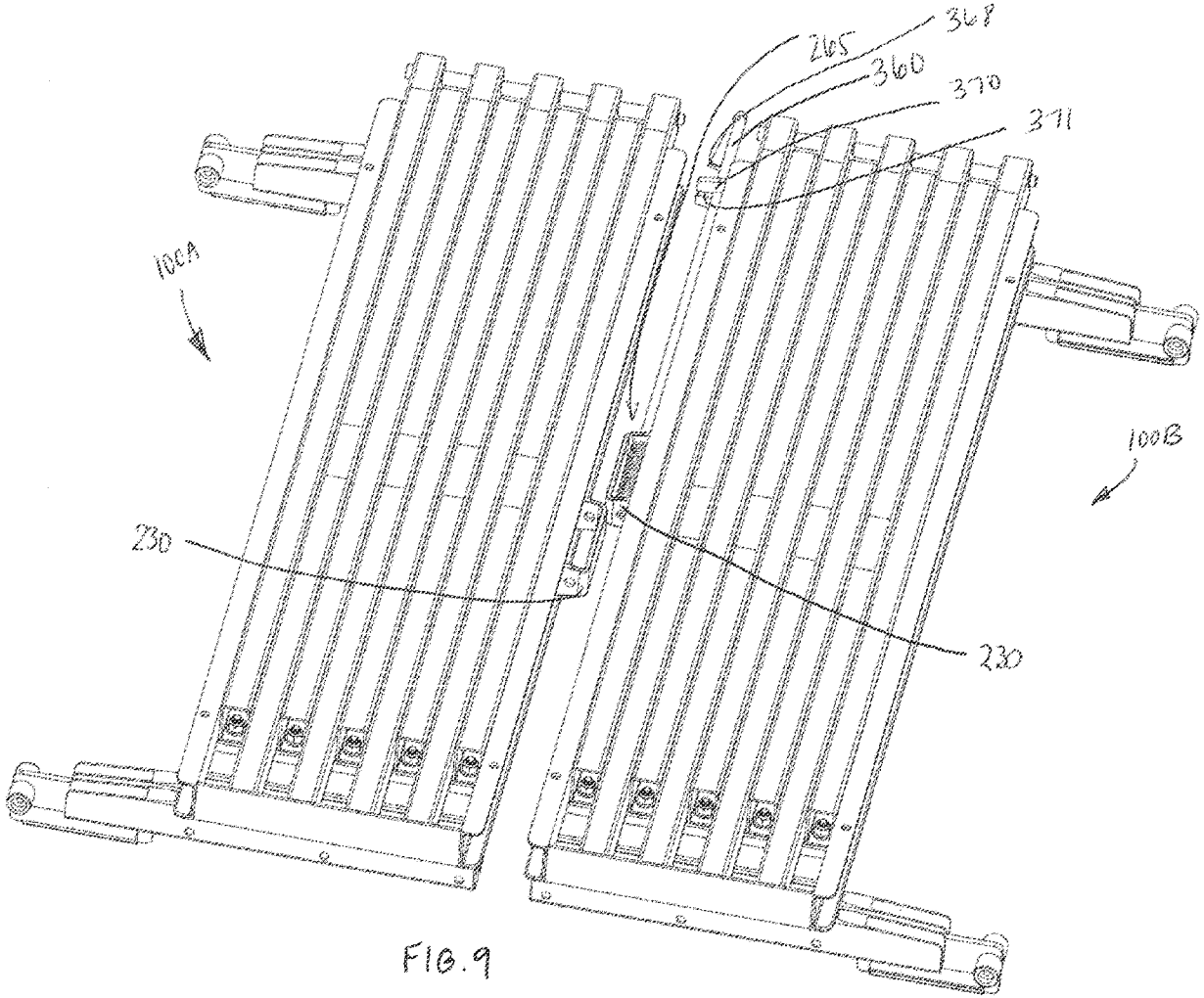
FIG. 9 is a top view of two respective combined extension and expansion panels in a nearly-joined configuration.
Figure 10:
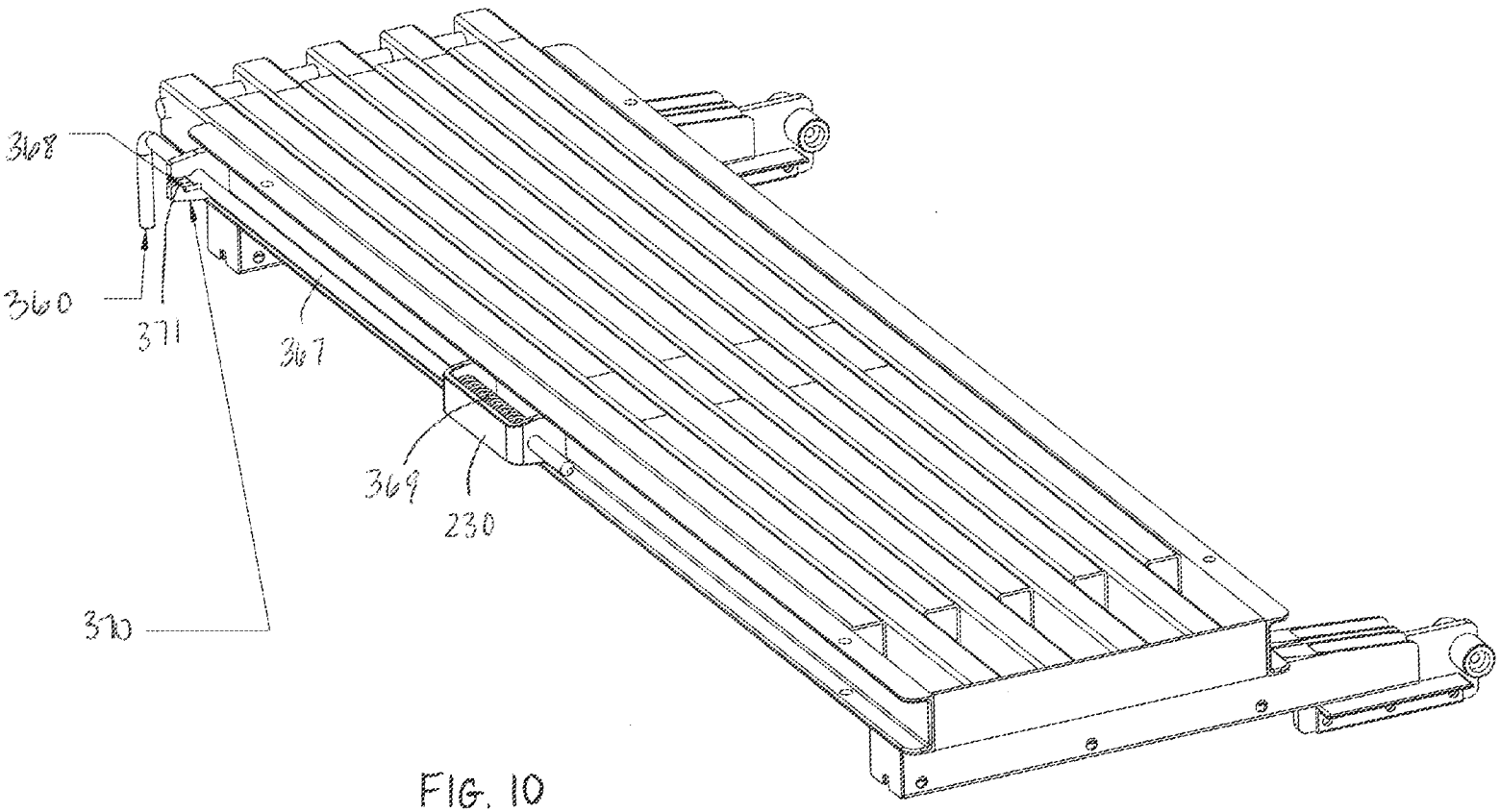
FIG. 10 is a side view of a combined extension and expansion panel showing a spring loaded handle.

FIGS. 8-10 illustrate alternative means for maintaining the extension panel 185 in a locked position with the expansion panel 180, and for fastening multiple tables 100 together. As shown in FIGS. 8A, 8B, and 8C, a spring loaded plunger 350 may be mounted on the expansion panel 180 (e.g., on a reinforcement member 133). The spring loaded plunger 350 may include a pin, a spring, and a grasping member. The pin of the spring loaded plunger 350 may be configured to engage with respective apertures formed into a tube 200 of the extension panel 185 and the reinforcement member 133 to prevent movement of the extension panel 185.

To move the extension panel 185 from the contracted position (FIGS. 8B and 8C) a user may pull on the grasping member causing the spring to contract and the pin to disengage from the respective apertures in the extension panel tubes 200. The extension panel 185 may then be translated longitudinally outward to the desired location. It may be understood by those of skill in the art that extension panel tube 200 may be equipped with a plurality of apertures spaced along the length of the tube 200 for engaging with the spring loaded plunger 350. In this way, the extension panel 185 may be extended a desired length which may be less than the entire length of the extension panel 185.

FIGS. 9 and 10 illustrate an alternative embodiment of a means for connection multiple transformer tables 100A, 100B together. As noted above, the expansion panel 180 may be equipped with handles 230 which may be used to help guide the expansion panel 180 laterally outward. Additionally, the handles 230 may be offset on respective right and left end plates 225 of two tables 100 to accommodate the connection 265 of the tables 100. However, here, the connection 265 between the tables 100 may be secured with a spring loaded handle 360.

The spring loaded handle 360 may include a pin 368 attached to a body portion 367 of the handle 360, and a spring 369 may be secured to an end of the handle 460 opposite the pin 368 such that the spring 369 is positioned inside the handle 230. The spring 369 may bias the spring loaded handle 360 away from the handle 230.

A spring lockout 370 may be secured (e.g., welded or otherwise attached) to the end plate 225 of one of the tables 100. For example, each table 100 may have a spring lockout 370 attached to the left end plate 225 as shown in FIGS. 9 and 10. The handle 360 may be inserted through a corresponding opening in the spring lockout 370 and a slot 371 in the spring lockout 370 may be configured to allow the pin 368 to pass therethrough.

To lock two tables 100 together, the handles 230 of the respective tables 100 may be placed adjacent one another. The spring loaded handle 360 may be inserted through the spring lockout 370 and rotated such that the pin 368 may pass through the slot 371 when a force is exerted on the handle 360. Once the pin 368 has passed through the slot 371, the handle 360 may be rotated such that the pin 368 contacts the lockout 370, preventing the spring 369 from biasing the spring loaded handle 360 back through the lockout 370 (i.e., the locked position). In the locked position, the spring loaded handle 260 engages with the adjacent handles 230 of the tables 100, thus connecting the two tables 100 together.

In still another embodiment, the table 100 may be equipped with a bar movably mounted to the platform 140 (e.g., at an underside of the platform 140). The table 100 may further have a socket for receiving a bar. To connect multiple tables 100 together, the bar may be pulled (or otherwise partially disengaged) from a first table 100 to be received by the socket in a second table 100. The bar may be held into place with acceptable mechanical fastening mechanisms, including but not limited to pins (spring loaded or otherwise), bolts, et cetera.

When the platform 100 is in the lowered position, the top of the platform may not be flush with the ground. Accordingly, ramps may be configured to attach to the platform 100 such that the vehicle can drive up the ramp to its position atop the platform 100. While many configurations of ramps may be acceptable, in one embodiment, the ramps may include at least one hook which may engage with the pin 245 in the extension panel 185 to attach the ramp to the platform 100.

Additionally, one end of the platform 100 may be designated the "front" of the platform, and stoppers may be provided on the ends of the panels 180, 185, and 190 to prevent the vehicle from rolling off the front of the platform 100. For example, the stoppers may have a substantially vertical configuration and may be welded, bolted, or otherwise attached to the "front" of the platform 100. If the vehicle rolls toward the front of the platform 100, the stoppers may prevent the vehicle from falling off the platform 100. It shall be understood by those of skill in the art that it may be preferable for the stoppers to be removably attached to the platform 100 such that the stoppers may be provided at both the front of the platform and the back of the platform to prevent the vehicle from falling off the front or the back, while also allowing the vehicle to be driven atop the platform.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Various steps in described methods may be undertaken simultaneously or in other orders than specifically provided.

What is claimed is:

1. A transformable table, comprising:

a lifting mechanism; and a platform secured to the lifting mechanism, the platform comprising:

a stationary panel;

a plurality of expansion panels positioned on either side of the stationary panel; and a plurality of extension panels in slidable engagement with the expansion panels and the stationary panel;

wherein:

the stationary panel, the expansion panels, and the extension panels are formed from a plurality of hollow tubes, the hollow tubes being spaced apart a predetermined distance thus forming spaces therebetween and secured together with a reinforcement member;

the expansion panels translate laterally outward from the stationary panel; and the extension panels translate longitudinally outward from the engagement with the expansion panels and the stationary panel.

2. The transformable table of claim 1, wherein the hollow tubes of the extension panels are configured to fit within the spaces formed between the hollow tubes of the stationary panel and the expansion panel.

3. The transformable table of claim 2, further comprising a platform support system, comprising:

a plurality of platform supports extending lengthwise along the outer edges of the table; and a plurality of expansion supports extending between, and supported by, the platform supports;

wherein:

each expansion support comprises two expansion support members paired together two expansion supports are paired together such that a channel is formed therebetween;

the expansion supports are secured to each end of the expansion panel; and at least one roller is positioned on an outside face of the platform support between the paired expansion support member.

4. The transformable table of claim 3, wherein each expansion panel further comprises a brace secured to the underside of the hollow tubes thereof, and wherein the brace is configured to fit within the channel formed between the expansion support member.

5. The transformable table of claim 4, wherein the brace further comprises a brace plate having a bracket secured thereto, wherein the bracket maintains the brace between the expansion support member.

6. The transformable table of claim 5, wherein an extension panel spring loaded latch engages with outer edges of the expansion panel to maintain each extension panel in a contracted position relative to the respective expansion panel, the spring loaded latch comprising:

a set of latch arms;

a spring received onto each latch arm; and an engagement member located at the end of each latch arm;

wherein each arm is inserted through a receptacle on a respective reinforcement member of the expansion panel such that, in a resting position, the springs are in an expanded position and the engagement members engage with respective apertures formed into respective outer edges of the expansion panel.

7. The transformable table of claim 6, wherein, in a traveling position, the arms of the spring loaded latch are squeezed together to disengage the engagement members from the respective outer edges of the expansion panel, thus allowing the extension panel to travel longitudinally outward from the contracted position to an expanded position.

8. The transformable table of claim 5, wherein a spring loaded plunger comprising a handle, a pin, and a spring, is mounted to an underside of the extension panel, and wherein:

in a first position, the spring biases the pin through corresponding apertures in the extension panel and the expansion panel thereby locking the extension panel in the first position with respect to the expansion panel; and in a second position, the spring is compressed by engaging the handle away from the expansion panel to separating the pin from the aperture in the expansion panel, thereby allowing the extension panel to travel longitudinally from the first position.

9. The transformable table of claim 8, wherein an expansion panel spring loaded latch engages with a respective innermost expansion support member of the expansion support to maintain the expansion panel in a contracted position, wherein the expansion panel spring loaded latch comprises:

a handle connected to a spindle; and a spring loaded onto the spindle;

wherein:

the spindle is inserted through a spring panel secured to the platform support such that the spring is on the side of the spring panel opposite the handle; and in a resting position, the spindle engages with the respective innermost expansion support member the expansion support to maintain the expansion panel in the contracted position.

10. The transformable table of claim 9, wherein, in a traveling position, the handle of the expansion panel spring loaded latch is pulled away from the respective expansion support member, causing the spring to contract and the spindle to disengage from the expansion support member, thus allowing the expansion panel to travel laterally outward from the contracted position to the expanded position.

11. The transformable table of claim 10, further comprising step plates secured under each of the respective expansion panels such that, when the expansion panels are in the contracted position, the step plates are obscured, and when the expansion panels are in the expanded position, the step plates are exposed.

12. The transformable table of claim 11, wherein each expansion panel further comprises an end plate secured lengthwise along the outside edges of the expansion panel, and wherein each end plate has a handle secured thereto.

13. The transformable table of claim 12, wherein the handles located on opposing end plates of the expansion panels of the transformable table are offset such that, when placed side-by-side, the handles of a first transformable table abut the handles of a second transformable table, and wherein a pin inserted through apertures formed in the respective handles secures the first and second transformable tables together.

14. The transformable table of claim 12, wherein the platform support system further comprises connection members for securing the platform to the lifting mechanism.

15. The transformable table of claim 14, wherein the hollow tubes of the expansion panels are angled at a first end.

16. The transformable table of claim 15, wherein a pin is inserted through an end of the hollow tubes of the extension panel corresponding to the angled end of the expansion panels, and wherein the pin in the extension panel clears the angle of the hollow tubes of the expansion panel when the extension panel is in the contracted position.

17. The transformable table of claim 15, wherein the hollow tubes of the stationary panel are angled at a first end, the first end of the stationary panel being the same as the first end of the expansion panels.

18. A transformable table, comprising:

a frame, comprising;

a base; and a hydraulic pump secured to the base;

a platform secured to the frame via a plurality of connection members, the platform comprising:

first and second platform supports;

a plurality of expansion supports extending perpendicularly between, and supported on, the platform supports, each expansion support having two expansion support members spaced apart so as to form a channel therebetween;

a stationary panel comprising a plurality of hollow tubes secured together at predetermined intervals, the stationary panel secured atop the expansion supports;

a plurality of expansion panels adjustably secured to the expansion supports, each expansion panel comprising:

a plurality of hollow tubes secured together at predetermined intervals; and a brace secured to an underside of the expansion panel, the brace having a conduit formed therein;

a plurality of extension panels, each extension panel comprising a plurality of hollow tubes secured together at predetermined intervals via a reinforcement member, wherein the hollow tubes of the extension panel are positioned in the spaces between the hollow tubes of the expansion panels;

wherein:

rollers are positioned between the space in the expansion supports;

the brace engages with the rollers such that the expansion panels are translatable in a laterally outward direction from a contracted position to an expanded position; and the extension panels are translatable in a longitudinally outward direction from a contracted position to an expanded position.

19. A transformable table, comprising:

a platform, comprising:

a stationary panel;

a plurality of expansion panels positioned on either side of the stationary panel;

a plurality of extension panels in slidable engagement with the stationary panel and the expansion panels; and step plates secured under each of the respective expansion;

wherein:

the stationary panel, the expansion panels, and the extension panels are formed from a plurality of hollow tubes, the hollow tubes being spaced apart a predetermined distance thus forming spaces therein and secured together with a reinforcement member;

the extension panels are positioned in the spaces formed between the hollow tubes of the stationary panel and the expansion panels;

the expansion panels translate laterally outward from a position adjacent the stationary panel; and the extension panels translate longitudinally outward from engagement with the stationary panel and the expansion panels; and a platform support system, comprising:

a plurality of platform supports extending lengthwise along, and secured to, the outer edges of the expansion panels;

a plurality of expansion supports extending between the platform supports; and a plurality of connection members extending lengthwise between, and secured to, the expansion supports;

wherein:

the expansion panels engage with rollers secured to the expansion supports to translate from the contracted position to the expanded position.

20. The transformable table of claim 19, wherein the connection members are secured to a lifting mechanism for moving the transformable table from a lowered position to a raised position.

* * * * *